US007182281B2

(12) United States Patent
Catasus-Servia

(10) Patent No.: US 7,182,281 B2
(45) Date of Patent: Feb. 27, 2007

(54) AIR ASSIST FUEL INJECTOR WITH A ONE PIECE LEG/SEAT

(75) Inventor: Jordi J. Catasus-Servia, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 337 days.

(21) Appl. No.: 10/698,022

(22) Filed: Oct. 31, 2003

(65) Prior Publication Data

US 2005/0098664 A1 May 12, 2005

(51) Int. Cl.
*F02M 51/00* (2006.01)

(52) U.S. Cl. ..... 239/585.1; 239/453; 239/533.7; 239/585.4

(58) Field of Classification Search ..... 239/433, 239/453, 533.7, 585.1, 585.4; 251/129.15, 251/129.21; 29/890.142, 890.143
See application file for complete search history.

(56) References Cited

U.S. PATENT DOCUMENTS

| | | | | |
|---|---|---|---|---|
| 4,795,097 | A * | 1/1989 | Greiner et al. | 239/585.4 |
| 4,875,658 | A | 10/1989 | Asai | |
| 4,934,329 | A | 6/1990 | Lear et al. | |
| 5,024,202 | A | 6/1991 | McKay | |
| 5,069,189 | A | 12/1991 | Saito | |
| 5,170,766 | A | 12/1992 | Haas et al. | |
| 5,172,865 | A * | 12/1992 | Takano et al. | 239/533.7 |
| 5,494,223 | A | 2/1996 | Hall et al. | |
| 5,685,485 | A | 11/1997 | Mock et al. | |
| 5,859,376 | A * | 1/1999 | Ishibashi et al. | 75/243 |
| 5,944,262 | A | 8/1999 | Akutagawa et al. | |
| 5,950,932 | A | 9/1999 | Takeda et al. | |
| 5,979,786 | A | 11/1999 | Longman et al. | |
| 5,983,865 | A | 11/1999 | Yamashita et al. | |
| 2003/0047624 | A1 | 3/2003 | Kilgore et al. | |

FOREIGN PATENT DOCUMENTS

| | | |
|---|---|---|
| EP | 0384473 A1 | 8/1990 |
| EP | 0404336 A1 | 12/1990 |
| EP | 0404357 A2 | 12/1990 |
| EP | 1239148 A2 | 9/2001 |
| WO | WO 97/02425 A1 | 1/1997 |
| WO | WO 97/12138 A1 | 4/1997 |

* cited by examiner

*Primary Examiner*—Steven J. Ganey
(74) *Attorney, Agent, or Firm*—Cooley Godward Kronish LLP

(57) ABSTRACT

An air assist fuel injector having a solenoid with a metallic core, an armature, and a solenoid coil for generating a magnetic field in the metallic core to actuate the armature. A poppet is attached to the armature. A single piece metallic body forms part of the metallic core of the solenoid. The body has an impact surface upon which the poppet repeatedly impacts during operation of the injector.

42 Claims, 4 Drawing Sheets

AIR ASSIST FUEL INJECTOR WITH A ONE PIECE LEG/SEAT

FIELD OF THE INVENTION

The present invention relates to air assist fuel injectors, and more particularly the leg and seat of such air assist fuel injectors.

DESCRIPTION OF THE RELATED ART

Conventional fuel injectors are configured to deliver a quantity of fuel to a combustion cylinder of an engine. To increase combustion efficiency and decrease pollutants, it is desirable to atomize the delivered fuel. Generally speaking, atomization of fuel can be achieved by supplying high pressure fuel to conventional fuel injectors, or by atomizing low pressure fuel with pressurized gas, i.e., "air assist fuel injection."

FIG. 1 illustrates a cross-section of a conventional air assist fuel injector 50. The conventional air assist fuel injector 50 receives a metered quantity of low pressure fuel from a conventional fuel injector (not illustrated) and pressurized air from a rail (not illustrated). The air assist fuel injector 50 atomizes the low pressure fuel with the pressurized air as it conveys the air and fuel mixture to the combustion chamber of an engine.

The pressurized air from the rail and the metered quantity of fuel from the conventional fuel injector enter the air assist fuel injector 50 through a cap 52, which delivers the fuel and air to a conduit of an armature 54. Thereafter, the fuel and air travel through a passageway of a poppet 56, and exit the poppet through small slots near the end or head of the poppet. The poppet 56 is attached to the armature 54, which is actuated by energizing a solenoid coil 58. When the solenoid coil 58 is energized, the armature 54 will overcome the force of a spring 60 and move toward a leg 62. Because the poppet 56 is attached to the armature 54, the head of the poppet will lift off a seat 64 when the armature is actuated so that the metered quantity of fuel is atomized as it is delivered to the combustion chamber of the engine.

As is illustrated in FIG. 1, the leg 62 and the seat 64 are two separate components of the air assist fuel injector 50, i.e., they are not a single piece or body. Rather, the seat 64 and leg 62 are separately formed, assembled, and then welded together. Unfortunately, the use of a separate leg 62 and seat 64 in air assist fuel injectors has caused several problems, including corrosion and cracking at the weld interface between the components, increased tolerance stack-ups on the assembly, and difficulty in manufacturing.

It is conventionally thought that the leg 62 and the seat 64 require different material specification and therefore must be formed as separate components because the leg 62 and the seat 64 serve different functions. In the conventional air assist fuel injector 50, the leg 62 is part of the metallic core through which the magnetic field flows when the solenoid coil is energized to actuate the armature 52. Thus, the leg 62 is typically formed from a solenoid grade stainless steel having good permeability, such as AISI 430Fr, which readily completes the magnetic circuit that actuates the armature 54. In contrast, the seat 64 is formed from a harder stainless steel, such as AISI 440, which is more suitable for the impact and bearing surfaces associated with the reciprocating movement of the poppet. Hence, materials that are suitable for the seat 64 are conventionally thought to be unsuitable for the leg 62, and vice versa. These competing demands have historically dictated that the leg 62 and the seat 64 be separately formed from different steels.

SUMMARY OF THE INVENTION

In light of the above-described problems of some conventional air assist fuel injectors, embodiments of the present invention generally strive to provide an air assist fuel injector having a one piece leg/seat.

Other advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings in the description are to be regarded as illustrative in nature, and not limitative.

DETAILED DESCRIPTION OF PREFERRED EMBODIMENTS

Figure 1:
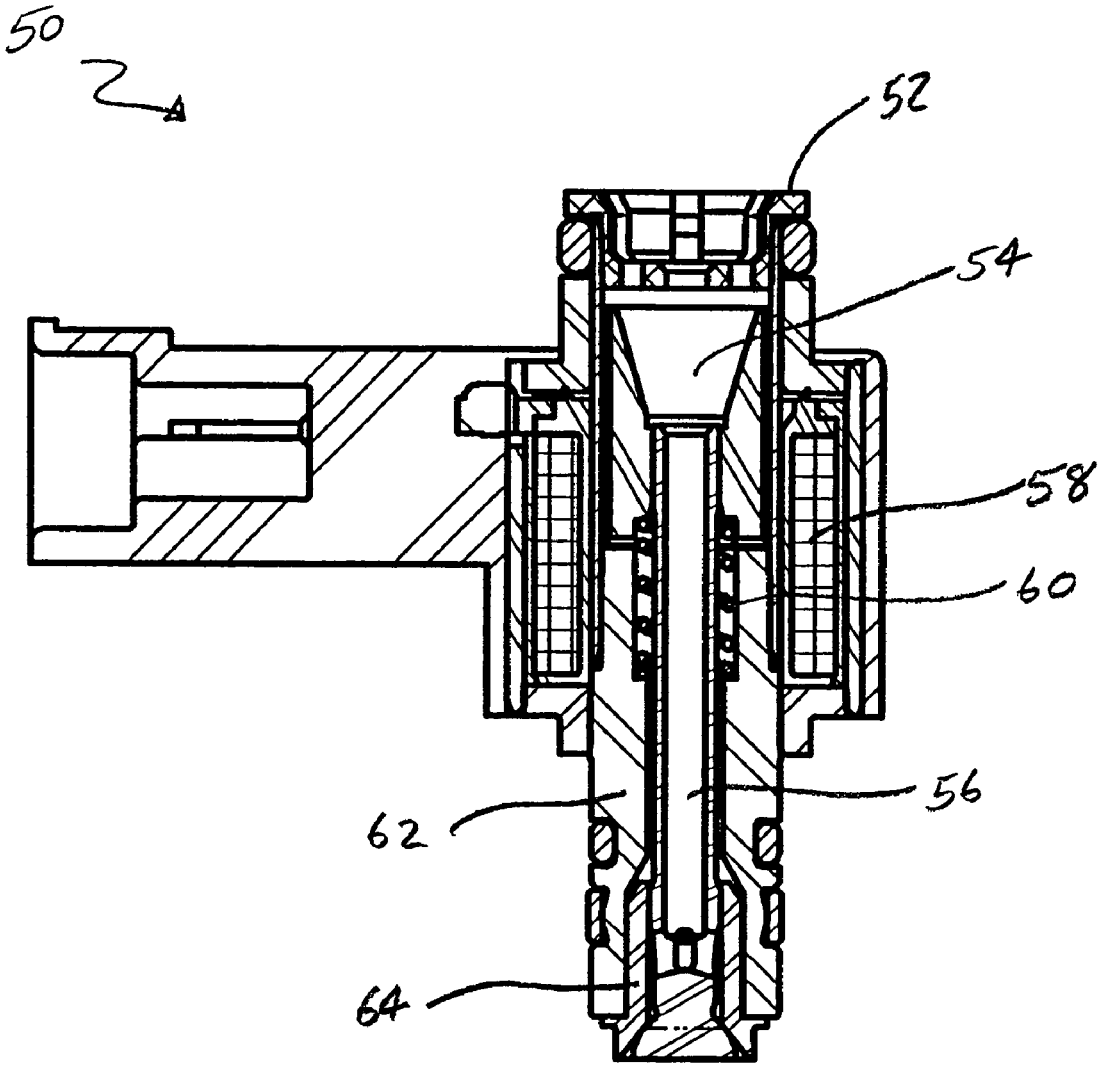
FIG. 1 PRIOR ART
FIG. 1 is a cross-sectional view of a conventional air assist fuel injector.
Figure 2:
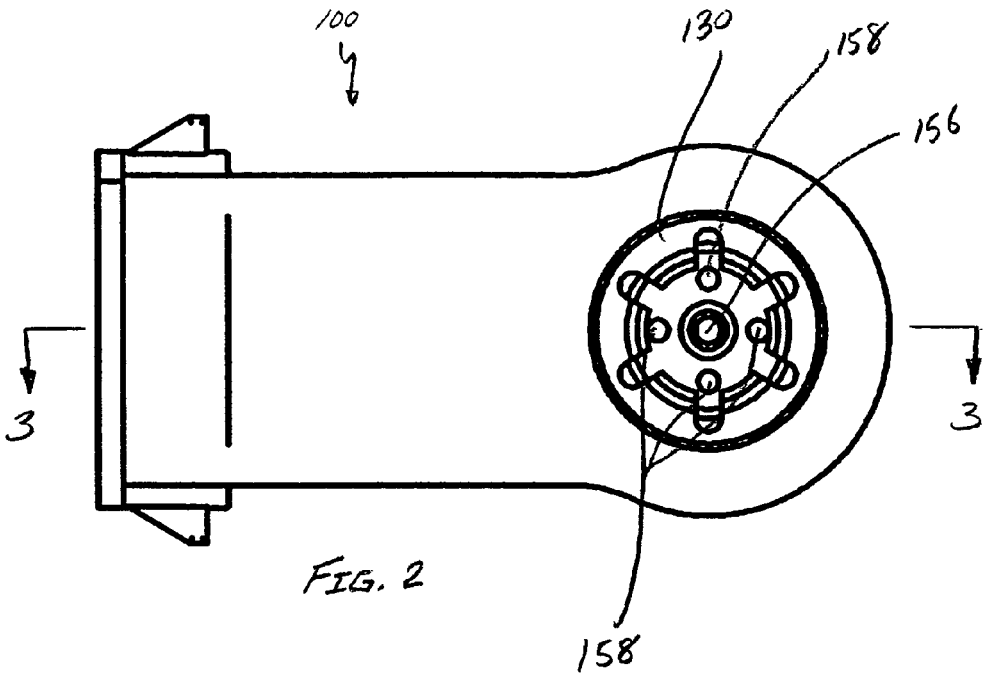
FIG. 2 is top view of an air assist fuel injector in accordance with one embodiment of the present invention.
Figure 3:
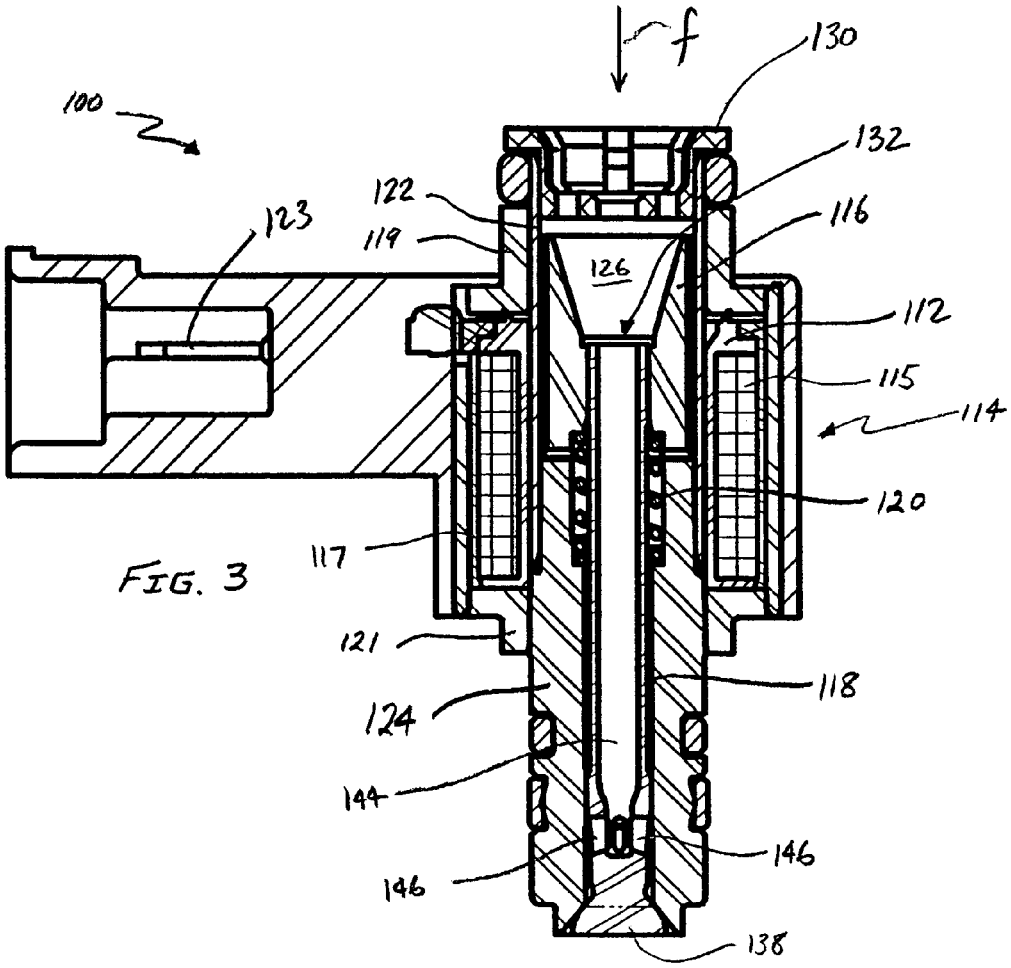
FIG. 3 is a cross-sectional view of the air assist fuel injector illustrated in FIG. 2 taken along the line 3—3 in FIG. 2.
Figure 4:
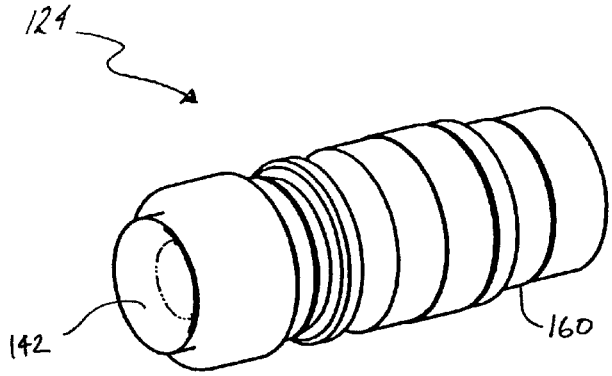
FIG. 4 is a perspective view of a one piece leg/seat of the air assist fuel injector illustrated in FIG. 2.

FIGS. 2 and 3 illustrate an air assist fuel injector 100 according to one embodiment of the present invention. As is described below, in the preferred embodiment, the air assist fuel injector 100 is configured to utilize pressurized gas to atomize low pressure liquid fuel, which together travel through the air assist fuel injector along a direction of flow f as indicated in FIG. 3. In the illustrated embodiment, the air assist fuel injector 100 is configured for use with a two-stroke internal combustion engine. When installed in an engine, the air assist fuel injector 100 is located such that the atomized low pressure fuel that exits the injector 100 is delivered to the internal combustion chamber of an engine. For example, the injector 100 may be located in a cavity of a two-stroke internal combustion engine head such that the fuel injector delivers a metered quantity of atomized liquid fuel to the combustion cylinder of the two-stroke internal combustion engine where it is ignited by a spark plug or otherwise. In alternative embodiments the air assist fuel injector is configured for operation with other engines and other applications. For example, the air assist fuel injector 100 may be configured for operation with a four stroke internal combustion engine or a rotary engine and may inject liquids other than fuel.

In a typical configuration, the air assist fuel injector 100 is located adjacent a conventional fuel injector (not illustrated), which delivers metered quantities of fuel to the air assist fuel injector. The conventional fuel injector may be located in the cavity of a rail or within a cavity in the head of an engine. The air assist fuel injector 100 is referred to as "air assist" because it preferably utilizes pressurized air to atomize liquid fuel. Although it is preferred that the air assist fuel injector 100 atomize liquid gasoline with pressurized air, it will be appreciated that the air assist fuel injector 100 may atomize many other liquids with any variety of gases. For example, the air assist fuel injector 100 may atomize oil, water, kerosene, or liquid methane with pressurized gaseous oxygen, propane, or exhaust gas. Hence, the term "air assist fuel injector" is a term of art, and as used herein is not intended to dictate that the air assist fuel injector 100 be used only with pressurized air and only with liquid fuel.

The fuel injector 100 includes a solenoid 114, which in the illustrated embodiment includes an armature 116, a solenoid coil 115 of conductive wire wrapped around a tubular bobbin 112, and a stationary metallic core described below. The solenoid coil 115 has two ends that are each electrically connected to terminals 123 and is energized by providing current to the terminals 123. The bobbin 112 of the solenoid 114 is a spool on which the conductive coil of the solenoid is wound, and defines a through hole in which the armature 116 of the solenoid 114 is electromagnetically actuated as further described below. The metallic core of the solenoid 114 is defined by multiple metallic pieces of the air assist fuel injector 100. More particularly, in the illustrated embodiment, the metallic core of the solenoid 114 is defined by a cylindrical casing 117, an upper retainer 119, a lower retainer 121, and a body 124, each of which is formed from a metallic material having a relative permeability $\mu_r$ such that the flux density though the core is adequate to actuate the armature when the solenoid coil 115 is energized. When the solenoid coil 115 is energized, a magnetic field is generated that flows through the metallic core, i.e., the cylindrical casing 117, the upper retainer 119, the lower retainer 121, and the body 124. As is illustrated in FIG. 3, the armature 116 is slightly spaced from the one piece leg/seat 124 by an air gap. Because the metallic core is an excellent magnetic conductor and air is a poor one, when the solenoid coil 115 is energized, the armature 116 is drawn by the magnetic field toward the one piece leg/seat 124 into a position abutting the one piece leg/seat. In this manner, the armature 116 is actuated when the solenoid coil 115 is energized. As is described below, the body 124 is a single piece that serves as both the leg and seat for the air assist fuel injector 100. Hence, the body 124 is referred to herein as the "one-piece leg/seat."

The cylindrical casing 117, the upper retainer 119, the lower retainer 121, and the armature 116 are preferably formed of solenoid grade metallic materials having a relative permeability $\mu_r$ such that the flux density though these items is sufficient to actuate the armature when the solenoid coil is energized. In a particularly preferred embodiment, the casing 117, the upper retainer 119, the lower retainer 121, and the armature 116 are formed of a ferretic stainless steel, such as AISI 430FR Stainless steel. Other suitable stainless steels include AISI 405, 409, 429, 434, 436, 442, and 446 stainless steels. In alternative embodiments, the stationary magnetic core of the solenoid 114 may include more or fewer components than the cylindrical casing 117, the upper retainer 119, and the lower retainer 121.

Figure 6:
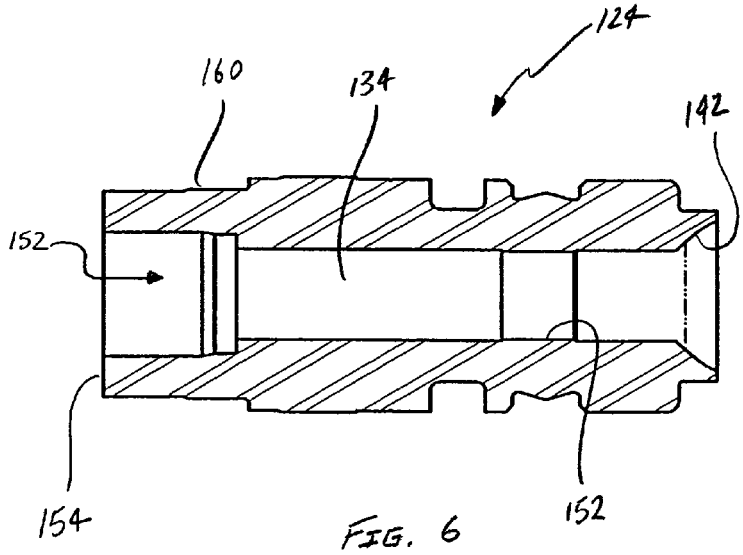
FIG. 6 is a cross-sectional view of the one piece leg/seat illustrated in FIG. 4 taken along the line 6—6 in FIG. 5.
Figure 8:
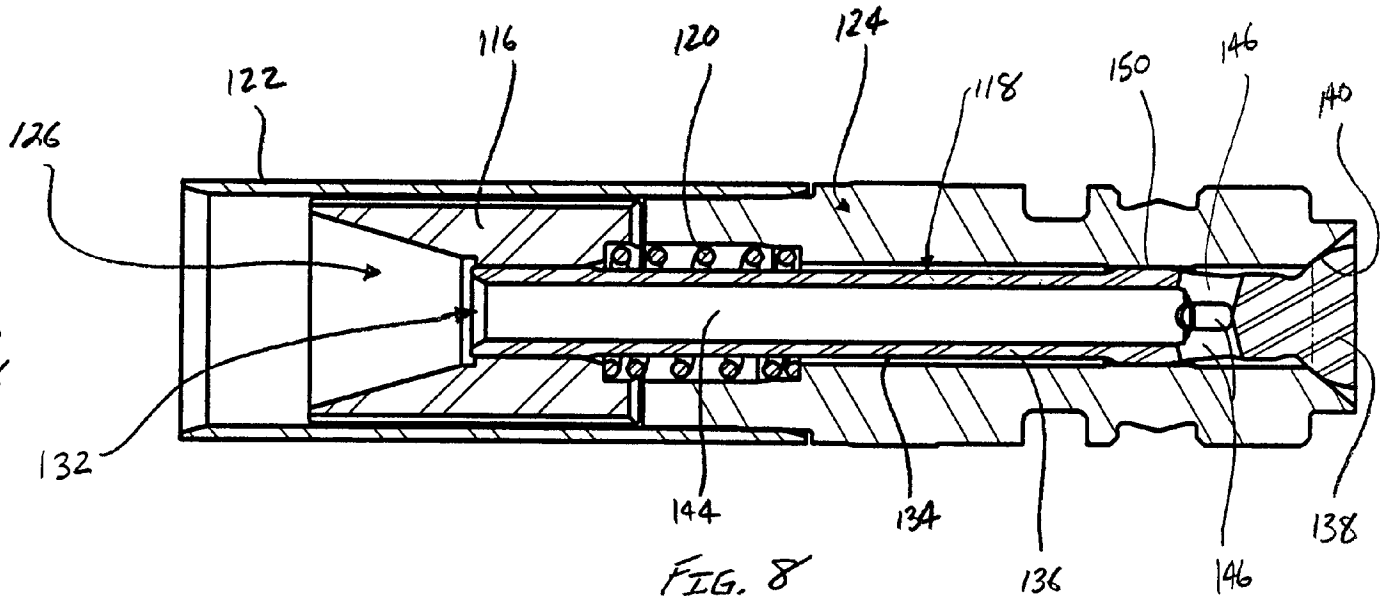
FIG. 8 is a cross-sectional view of the valve assembly illustrated in FIG. 7 taken along the line 8—8 in FIG. 7.
Figure 7:
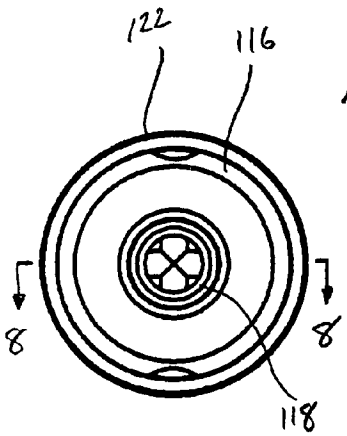
FIG. 7 is a top view of the valve assembly of the air assist fuel injector illustrated in FIG. 2.

The illustrated armature 116 is received by and is located relative to the cylindrical sleeve 122 such that the sleeve serves as a bearing to guide the armature as the armature moves within the sleeve. In an alternative embodiment, the fuel injector 100 does not include the sleeve 122 and movement of the armature is not guided by a bearing on a surface of the armature. As is illustrated in FIGS. 6 and 8, the one piece leg/seat 124 includes a section 160 having a reduced diameter and that is received by the sleeve 122, preferably by a press-fit. The sleeve 122 is preferably attached to the one piece leg/seat 124 with a weld, such as a YAG laser weld that defines a hermetic seal between the sleeve and the one piece leg/seat.

The illustrated armature 116 also includes a conduit 126 that receives liquid fuel and gas from a cap 130 and that conveys the mixture of liquid fuel and gas to an inlet 132 of the poppet 118. Hence, in the preferred embodiment, the cap 130 defines an inlet to the air assist fuel injector 100 for the pressurized gas and liquid fuel. The cap 130 serves to direct the liquid fuel and gas to the conduit 126 of the armature 116. The cap 130 includes one fuel passageway 156 having an inlet that primarily receives liquid fuel and four gas passageways 158 each having an inlet that primarily receives pressurized gas. The liquid fuel passageway 156 is located along the center axis of the cap 130, and the gas passageways 158 are circumferentially and equally spaced about the liquid fuel passageway 156. Alternative embodiments of the air assist fuel injector 100 need not include the cap 130, and alternative embodiments of the cap 130 may include more or fewer passageways 156, 158. In an alternative embodiment, the conduit 126 of the armature does not extend through the armature. In still a further embodiment, the armature 116 does not include the conduit 126. In this alternative embodiment, liquid fuel flows outside the armature and downstream the air assist fuel injector 100.

The poppet 118 is attached to the armature 116. Because the poppet 118 is attached to the armature 116, the poppet will move with the armature when the armature is actuated by energizing the solenoid coil 115. The poppet 118 is a member that opens and closes to control the discharge of fuel from the fuel injector 100. When the poppet 118 opens and closes, it reciprocates in a channel 134 of the one piece leg/seat 124. In the illustrated embodiment, the poppet 118 includes a stem 136 and a head 138. In reference to FIGS. 6 and 8, the head 138 includes a sealing surface 140 that abuts an impact surface 142 of the one piece leg/seat 124 when the fuel injector is closed. When the fuel injector is open, the sealing surface 140 is spaced away from the impact surface 142 of the one piece leg/seat 124. In the preferred embodiment, the sealing surface 140 includes an angled and annular face that defines a contact ring, which contacts the impact surface 142 of the one piece leg/seat 124 to define a seal between the poppet 118 and the one piece leg/seat 124. The poppet 118 is fabricated from a metallic material, such as iron, aluminum, titanium, and their alloys. In one embodiment, the poppet 118 is an austenitic, ferretic, or martensitic stainless steel. In a preferred embodiment, the poppet is formed of a 400 series stainless steel.

In the illustrated embodiment, the poppet 118 includes an interior channel 144 that extends from the inlet 132 of the poppet 118 to an outlet 146 of the poppet located upstream of the head 138. In the preferred embodiment, the poppet 118 includes four slot-shaped outlets 146 that are equally spaced from each other and located approximately transverse to a longitudinal axis of the poppet 118. Although it is preferred that the poppet 118 have four slot-shaped outlets 146, other configurations will suffice. For example, the poppet 118 may include one slot-shaped outlet, two circular outlets, five oval outlets, ten pin sized outlets, or other combinations of numbers and shapes.

As is described above, the sealing surface 140 of the head 138 seats against the one piece leg/seat 124 when the solenoid coil 115 is not energized. When the armature 116 is actuated by energizing the solenoid coil 115, the poppet 118 moves with the armature 116 such that the head 138 is lifted off of the one piece leg/seat 124 in a direction away from the fuel injector 100. Hence, the poppet 118 is an outwardly opening poppet. When the head 138 is lifted off of the one piece leg/seat 124, a seal is broken between the head 138 and the one piece leg/seat 124 at the impact surface 140 such that liquid fuel and gas exiting the outlets 146 exits the air assist fuel injector 100. In an alternative embodiment of the air assist fuel injector 100, the poppet 118 is solid, i.e., it does not include the inlet 132, the outlets 146, and the interior channel 144, such as is described in U.S. patent application Ser. No. 09/950,586. In this solid-poppet embodiment, the liquid fuel travels externally to the poppet. In another embodiment, the poppet 118 is an inwardly opening poppet. That is, to discharge the fuel from the fuel injector, the poppet and armature move opposite the direction of flow f such that the poppet head 138 lifts inwardly off of the one piece leg/seat 124 to discharge fuel from the air assist fuel injector.

Figure 5:
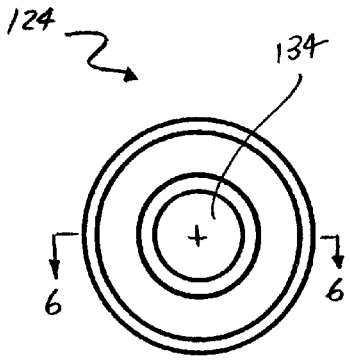
FIG. 5 is a top view of the one piece leg/seat illustrated in FIG. 4.

As is illustrated in FIGS. 5, 6 and 8, the one piece leg/seat 124 includes an elongated and cylindrical channel 134 in which the poppet 118 reciprocates. Movement of the poppet 118 is guided by a bearing 150 that is located in the channel 134 upstream of the outlets 146 with respect to the direction of flow f of the liquid fuel and the gas through the injector 100. Hence, as is illustrated in FIG. 6, the one piece leg/seat 124 includes a bearing surface 152 that engages a corresponding bearing surface of the poppet 118 to guide movement of the poppet. In alternative embodiments, the one piece leg/seat 124 need not include a bearing surface that guides movement of the poppet. For example, movement of the poppet 118 may be guided at other locations upstream of the one piece leg/seat 124. In a further alternative embodiment, the one piece leg/seat 124 includes multiple bearing surfaces 152 for guiding movement of the poppet 118 at different locations.

The interior channel 134 of the one piece leg/seat 124 through which the poppet 118 moves also serves as a secondary flow path for the pressurized gas. Hence, when the head 138 lifts off of the one piece leg/seat 124, pressurized gas flows outside of the poppet 118 but inside the channel 134 of the one piece leg/seat 124 to help atomize the liquid fuel and the gas exiting the outlets 146.

The spring 120 is located between the armature 116 and the one piece leg/seat 124. More particularly, the spring 120 is located within a recessed bore 152 of the one piece leg/seat 124 that is concentric with and part of the elongated channel 134 of the one piece leg/seat 124. The bore 152 faces the armature 116 and defines the seat for the spring 120. The spring 120 is a compression spring having a first end that abuts the armature 116 and a second end that abuts the one piece leg/seat 124. The bottom of the bore 152 defines the seat for the downstream end of the spring and a recess in the armature 116 defines a seat for the upstream end of the spring 120. The spring 120 functions to bias the armature 116 away from the one piece leg/seat 124. When the solenoid coil 115 is not energized, the spring 120 biases the armature 116 away from the one piece leg/seat 124 and thus the poppet 118 is maintained in a closed position where the head 138 abuts the impact surface 142 of the one piece leg/seat 124. However, when the solenoid coil 115 is energized, the electromagnetic forces cause the armature 116 to overcome the biasing force of the spring 120 such that the armature 116 moves toward the one piece leg/seat 124 until it abuts a stop surface 154 of the one piece leg/seat 124. When the solenoid coil 115 is de-energized, the electromagnetic force is removed and the spring 120 again forces the armature 116 away from the stop surface 154. As will be appreciated, in alternative embodiments of the fuel injector 100, the spring 120 may be located at different positions and still be within the confines of the present invention. For example, in one inwardly-opening embodiment of the fuel injector, the spring 120 is located at the upstream end of the armature and biases the armature toward the one piece leg/seat 124.

As is described above, the one piece leg/seat 124 is part of the stationary metallic core of the solenoid 114. That is, the one piece leg/seat 124 is part of the magnetic loop or circuit through which the magnetic field flows when the solenoid coil 115 is energized. Hence, when the solenoid coil 115 is energized, the magnetic field flows through the metallic core defined by the casing 117, the upper retainer 119, the lower retainer 121, and one piece leg/seat 124. Thus, the one piece leg/seat is located relative to the solenoid coil 115 and other portions of the multi-piece core of the solenoid 114 such that it is subject to the lines of magnetic flux generated by the solenoid coil 115. More particularly, in the illustrated embodiment the one piece leg/seat 124 is preferably located partially within the conduit defined by the solenoid 114. As will be appreciated, in an alternative embodiment the one piece leg/seat 124 and/or armature 116 could be located slightly outside the conduit of the solenoid 114 and still be part of the magnetic core and still be subject to the lines of magnetic flux generated by the solenoid.

Because the one piece leg/seat 124 is part of the of the magnetic circuit that is created when the solenoid coil 115 is energized, is it preferable that it be formed from a metallic material having a relative permeability $\mu_r$ that is sufficient to cause activation of the armature when the solenoid coil 115 is energized. The one piece leg/seat 124 is also preferably hard enough to serve as a bearing surface for poppet movement, absorb the impact of the head 138 when the poppet 118 opens and closes, and absorb the impact of the armature 116. Additionally, because the one piece leg/seat 124 typically operates in a corrosive environment, is it preferably fabricated from a corrosion-resistant material. In these respects, it is preferred that the material for the one piece leg seat 124 have a relative permeability $\mu_r$ of at least 100, a hardness of at least 80 HRB, and a resistance to corrosion greater than that of 12L14 steel. In even a more preferred embodiment, the material for the one piece leg seat 124 has a relative permeability $\mu_r$ of at least 100, a hardness of at least 92 HRB, and resistance to corrosion at least equal to that of AISI 416. Hence, it is preferred that the one piece leg/seat 124 be a magnetic conductor that completes the magnetic circuit generated by the solenoid coil 115, while also being sufficiently hard to absorb impacts of the poppet and the armature at the impact surface without changing the gap between the one piece leg/seat 124 and the armature 116 more then 10%, preferably not more than 5%, when measured after 500 million cycles.

There are a number of different materials that satisfy the above-noted characteristics of the one piece leg/seat 124, such as hardened AISI 416 stainless steels, hardened AISI 430 stainless steels, and annealed AISI 440 stainless steels. In one embodiment, the one piece leg/seat 124 is a 41600 stainless steel with hardness of 32 HRC. In another embodiment, the one piece leg/seat 124 is a 43020 stainless steel with hardness of 92 HRB. In a further embodiment, the one piece leg/seat 124 is a 44020 stainless steel.

In one particularly preferred embodiment, the one piece leg/seat 124 is formed from 41600 stainless steel that has been hardened to between 32–38 HRC with a through hardening process. As will be appreciated, other stainless steels and alloys other than stainless steel will also suffice for the one piece leg/seat 124, depending upon the specifications of the injector and its operating environment. For example, depending upon the configuration of the injector and its application, the one piece leg seat could be fabricated from one or more of the following alloys: Carpenter Stainless Type 303; Carpenter Stainless Type 416 (No. 5); Carpenter Stainless Type 304HN; CRB-7 Alloy; Carpenter Glass Sealing "27"; Chrome Core 18-FM Solenoid Quality Stainless; Chrome Core 29 Solenoid Quality Stainless; Gall-Tough Stainless; Project 70+; Type 304/304L Stainless; Project 70+Type 316/316L Stainless; TrimRite Stainless; 7-Mo Stainless; Carpenter 18Cr-2Ni-12Mn; Carpenter 21Cr-6Ni-9Mn; Carpenter Stainless Type 182-FM; Carpenter Stainless Type 203; Carpenter Stainless Type 430FR Solenoid Quality; Project 70+Type 416 Stainless; and Pyromet Alloy 350. Other materials having different properties and characteristics than those set forth above could also suffice, depending upon the application and the configuration of the injector.

In the preferred embodiment, the one piece leg/seat 124 is fabricated by machining bar stock of stainless steel having a uniform metal composition that has been previously through hardened to 32–38 HRC. In alternative embodiments, the one piece leg/seat 124 is fabricated by casting, molding, forging, or other conventional metal working processes. Additionally, in other embodiments the metal is hardened by case hardening or induction hardening, before or after machining. In a further embodiment, the one piece leg/seat 124 is not hardened, or is only hardened at specific locations, such as at the bearing surface 152, the impact surface 142, and/or the impact surface 154. For example, the impact surface 142 and/or the bearing surface 152, and/or the impact surface 154 could be hardened with a nitriding process. In still a further embodiment, the one piece leg/seat 124 includes a coating, i.e., a layer of substance spread over and bonded to a surface of the one piece leg/seat 124. The coating may be located over the entire exterior surface of the one piece leg/seat or may only be located at specific areas, such as at the bearing surface 152, the impact surface 142, and/or the impact surface 154. Such a coating is a solid-phase, i.e., non-fluid, after its application and is one or more of numerous coatings that increase resistance to wear, such as organic coatings, inorganic coatings, and metallic coatings. Suitable coatings include chromium nitride coatings, nickel phosphorous coatings, diamond-like-carbon coatings, nickel coatings, and iron nitride coatings. Suitable coatings may be applied by hot or cold dipping, electroplating, spraying, and by deposition from solution.

As is set forth above, in previous air assist fuel injector designs the leg and seat are formed as separate components because the leg and the seat served different functions, which were conventionally thought to require different materials. That is, in previous air assist fuel injectors, the leg is typically formed from a solenoid grade soft stainless steel having low electrical resistivity that readily completes the magnetic circuit that actuates the armature, while the seat is formed from a harder stainless steel that is more suitable for the impact and bearing surfaces associated with the reciprocating movement of the poppet. Going against this conventional wisdom, the applicant discovered that some materials satisfied the requirements of both the seat and the leg such that the seat and the leg could be fabricated as one piece, i.e., the one piece leg/seat 124 described above. Hence, preferred embodiments of the invention concern a one piece leg/seat of a material suitable for durability, magnetic circuitry, and corrosion resistance. By joining the design of the leg and seat as one component and selecting an appropriate material, several aspects of the air assist fuel injector are improved. First, the combination of the leg and seat as one component allows for tighter tolerances of design because there is no need to process each component separately. Second, manufacturing time and scrap material is reduced because one part is produced, which also simplifies the assembly of the entire injector. Third, the use of a single component for the leg and seat address several historical quality issues associated with welding and assembling the leg and the seat. Fourth, the overall cost of injector production is reduced as a results of the manufacturing, processing and quality improvements. The integration of the leg and seat as a single item thus improves the functionality and the manufacturing of a traditional and historical approach. As a result, there is a direct, and more accurate, relation between the sealing surface, the bearing surface and the impact surface on the injector with minimal processing.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the spirit and scope of the present invention as defined in the claims be embraced thereby.

The invention claimed is:

1. An air assist fuel injector, comprising:

a solenoid having a metallic core, an armature, and a solenoid coil for generating a magnetic field in said metallic core to actuate said armature;

a poppet attached to said armature; and a single piece metallic body that forms part of said metallic core of said solenoid, said body having an impact surface upon which said poppet repeatedly impacts during operation of said injector, a portion of said body configured to be engaged by said armature.

2. The air assist fuel injector of claim 1, said body having a relative permeability of at least 100.

3. The air assist fuel injector of claim 2, said relative permeability being at least 300.

4. The air assist fuel injector of claim 1, said hardness being at least 92 HRB.

5. The air assist fuel injector of claim 1, said body being located directly adjacent said armature such that the armature impacts said body when it is actuated by said solenoid.

6. The air assist fuel injector of claim 1, said body include a bearing surface for said poppet.

7. The air assist fuel injector of claim 1, said body being formed from one of the following families of stainless steels:

AISI 416 stainless steels:

AISI 430 stainless steels; and

AISI 440 stainless steels.

8. The air assist fuel injector of claim 7, said body being one of said AISI 416 stainless steels.

9. The air assist fuel injector of claim 8, said body being AISI 41600 stainless steel.

10. The air assist fuel injector of claim 7, said body being one of said AISI 440 stainless steel.

11. The air assist fuel injector of claim 10, said body being 44004 stainless steel.

12. The air assist fuel injector of claim 10, said body being one of said 44020 stainless steel.

13. The air assist fuel injector of claim 1, said body being a ferromagnetic stainless steel.

14. The air assist fuel injector of claim 1, further comprising a spring that biases said armature away from said body, said body having a channel in which said poppet reciprocates during operation of said injector, said channel receiving said spring.

15. The air assist fuel injector of claim 1, further comprising a sleeve attached to said body, said sleeve receiving said armature.

16. The air assist fuel injector of claim 15, said sleeve being attached to said body with a weld.

17. The air assist fuel injector of claim 15, further comprising a cap for receiving liquid fuel and gas, said sleeve receiving said cap.

18. The air assist fuel injector of claim 1, said armature having a passageway for conveying liquid fuel and gas.

19. The air assist fuel injector of claim 1, said poppet having a passageway for conveying liquid fuel and gas.

20. The air assist fuel injector of claim 1, the injector being configured such that said poppet opens in a direction away from said injector to discharge fuel and gas from the injector.

21. The air assist fuel injector of claim 1, a portion of said body being hardened, said portion being at least one of said impact surface and a bearing surface of said body.

22. The air assist fuel injector of claim 1, a portion of said body including a solid phase coating thereon, said portion being at least one of said impact surface and a bearing surface of said body.

23. The air assist fuel injector of claim 1, said body having a hardness of at least 80 HRB.

24. The air assist fuel injector of claim 1, said body having a relative permeability of at least 100 and a hardness of at least 80 HRB.

25. The air assist fuel injector of claim 1, said body having a relative permeability of at least 100 and a hardness of at least 32 HRC.

26. An air assist fuel injector, comprising:

a solenoid having a metallic core, an armature, and a solenoid coil for generating a magnetic field in said metallic core to actuate said armature;

a poppet attached to said armature; and a single piece stainless steel body that forms part of said metallic core of said solenoid, said body having an impact surface upon which said poppet repeatedly impacts during operation of said injector, an end portion of said body being adjacent said solenoid coil.

27. The air assist fuel injector of claim 26, said body being AISI 416 stainless steel.

28. The air assist fuel injector of claim 26, said body being AISI 440 stainless steel.

29. The air assist fuel injector of claim 26, said body being AISI 430 stainless steel.

30. The air assist fuel injector of claim 26, said body being located directly adjacent said armature such that the armature impacts said body when it is actuated by said solenoid.

31. The air assist fuel injector of claim 26, said body include a bearing surface for said poppet.

32. The air assist fuel injector of claim 26, further comprising a spring that biases said armature away from said body, said body having a channel in which said poppet reciprocates during operation of said injector, said channel receiving said spring.

33. The air assist fuel injector of claim 26, further comprising a sleeve attached to said body, said sleeve receiving said armature.

34. The air assist fuel injector of claim 33, said sleeve being attached to said body with a weld.

35. The air assist fuel injector of claim 33, further comprising a cap for receiving liquid fuel and gas, said sleeve receiving said cap.

36. The air assist fuel injector of claim 26, said armature having a passageway for conveying liquid fuel and gas.

37. The air assist fuel injector of claim 26, said poppet having a passageway for conveying liquid fuel and gas.

38. The air assist fuel injector of claim 26, the injector being configured such that said poppet opens in a direction away from said injector to discharge fuel and gas from the injector.

39. The air assist fuel injector of claim 26, wherein said body has a permeability of at least 100, a hardness of at least 80 HRB, and a corrosion resistance greater than that of 12L14 steel.

40. An air assist fuel injector comprising:

a solenoid having a metallic core, an armature, and a solenoid coil for generating a magnetic field in said metallic core to actuate said armature;

a poppet attached to said armature; and a single piece metallic body that forms part of said metallic core of said solenoid, said body having an impact surface upon which said poppet repeatedly impacts during operation of said injector, said metallic body having an end portion configured to be engaged by said armature, said metallic body being formed of a material having a relative permeability sufficient to actuate said armature when said solenoid coil is energized, said material also being sufficiently hard to absorb impact of said poppet and said armature without substantial deformation.

41. An air assist fuel injector, comprising:

a solenoid having a metallic core, an armature, and a solenoid coil for generating a magnetic field in said metallic core to actuate said armature;

a poppet attached to said armature; and a single piece metallic body that forms part of said metallic core of said solenoid, said body having an impact surface upon which said poppet repeatedly impacts during operation of said injector, said body having an end portion adjacent said amature.

42. The air assist fuel injector of claim 41, wherein said body has a relative permeability of at least 100.

* * * * *